United States Patent [19]

Wilhelm

[11] Patent Number: 4,490,669

[45] Date of Patent: Dec. 25, 1984

[54] CIRCUIT CONFIGURATION FOR GENERATING A TEMPERATURE-INDEPENDENT REFERENCE VOLTAGE

[75] Inventor: Wilhelm Wilhelm, Munich, Fed. Rep. of Germany

[73] Assignee: Siemens Aktiengesellschaft, Berlin and Munich, Fed. Rep. of Germany

[21] Appl. No.: 416,084

[22] Filed: Sep. 8, 1982

[30] Foreign Application Priority Data

Sep. 21, 1981 [DE] Fed. Rep. of Germany ..... 3137504

[51] Int. Cl.[3] ..... G05F 3/20

[52] U.S. Cl. ..... 323/313; 323/907; 307/296 R

[58] Field of Search ..... 323/313, 314, 315, 316, 323/907; 307/296 R, 297, 310

[56] References Cited

U.S. PATENT DOCUMENTS

| | | | |
|---|---|---|---|
| 3,886,435 | 5/1975 | Steckler | 323/315 |
| 4,249,122 | 2/1981 | Widlar | 323/313 |
| 4,258,311 | 3/1981 | Tokuda et al. | 323/313 |

OTHER PUBLICATIONS the Book by U. Tietze and Ch. Schenk, Titled "Halbleiter-Schaltungstechnik" 5th Revised Edition, Springer-Verlag, Berlin, Heidelberg, New York, 1980, pp. 387 et seq.

Article by D. Hampel, Titled Stable Voltage Reference Sources, in "IEEE Journal of Solid State Circuits, SC-7 (1972), pp. 267 to 269.

G. L. Crauwels, "Temperature and Power Supply Insensitive Voltage Reference", IBM Technical Disclosure Bulletin, vol. 19, No. 10, Mar. 1977, pp. 3782-3783.

*Primary Examiner*—Peter S. Wong

*Attorney, Agent, or Firm*—Herbert L. Lerner; Laurence A. Greenberg

[57] ABSTRACT

Bandgap circuit for generating a temperature-independent reference voltage, including a diode-resistance path at which a temperature-independent reference voltage corresponding to the energy gap of semiconductor material of components used in the circuit is available, the diode-resistance path including a diode and a series circuit of at least two resistors being connected in parallel with the diode, a temperature-independent reference voltage which is independent of the energy gap of the semiconductor material being available at one of the resistors.

2 Claims, 3 Drawing Figures

CIRCUIT CONFIGURATION FOR GENERATING A TEMPERATURE-INDEPENDENT REFERENCE VOLTAGE

The present invention relates to a circuit configuration for generating a temperature-independent reference voltage in the form of a bandgap circuit, in which the temperature-independent reference voltage corresponding to the bandgap or energy gap of the semiconductor material of the components used in the circuit, can be taken off at a diode-resistor path.

Bandgap circuits of the type mentioned above are known and are described, for instance, in the Book "Halbleiter-Schaltungstechnik" by U. Tietze and Ch. Schenk, 5th revised edition, Springer-Verlag, Berlin, Heidelberg, New York, 1980, Page 387 et seq., and in "IEEE Journal of Solid State Circuits, SC-7 (1972), Pages 267 to 269.

In such a bandgap circuit, a temperature-independent reference voltage which corresponds to the bandgap or energy gap of the semiconductor material of the components used in the circuit can be taken off at the diode-resistor path. For silicon, this voltage is approximately equal to 1.2 volts.

However, it is not possible with such prior art devices to generate a temperature-independent reference voltage which has a value that differs from the bandgap or energy gap voltage of the semiconductor material being employed.

It is accordingly an object of the invention to provide a circuit configuration for generating a temperature-independent reference voltage, which overcomes the hereinafore-mentioned disadvantages of the heretofore-known devices of this general type, and to further develop a circuit of the type mentioned above in such a manner that the temperature-independent reference voltages can also be generated with a value which differs from the bandgap voltage of the semiconductor material used.

With the foregoing and other objects in view there is provided, in accordance with the invention, a bandgap circuit for generating a temperature-independent reference voltage, including a diode-resistance path at which a temperature-independent reference voltage corresponding to the energy gap of semiconductor material of components used in the circuit is available, the diode-resistance path comprising a diode and a series circuit of at least two resistors being connected in parallel with the diode, a temperature-independent reference voltage which is independent of the energy gap of the semiconductor material being available at one of the resistors.

Other features which are considered as characteristic for the invention are set forth in the appended claim.

Although the invention is illustrated and described herein as embodied in a circuit configuration for generating a temperature-independent reference voltage, it is nevertheless not intended to be limited to the details shown, since various modifications and structural changes may be made therein without departing from the spirit of the invention and within the scope and range of equivalents of the claim.

The construction and method of operation of the invention, however, together with additional objects and advantages thereof will be best understood from the following description of specific embodiments when read in connection with the accompanying drawings, in which.

Figure 1:
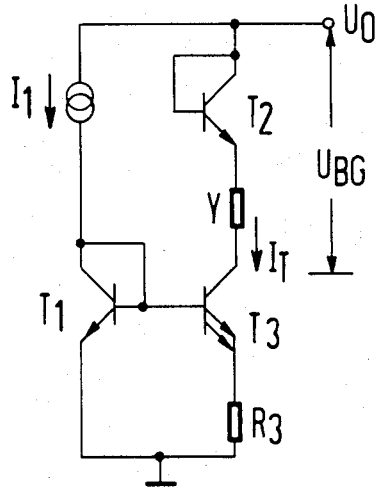
PRIOR ART FIG 1
FIG. 1 is a schematic circuit diagram of a prior art bandgap circuit.

Reference will now be made to the figures of the drawing and first particularly to the known bandgap circuit shown in FIG. 1 of the drawing. In this embodiment of a bandgap circuit, two branches are provided. One branch is formed by a transistor $T_1$ which is connected as a diode with a current source $I_1$ impressing a current, and the other branch is formed by a transistor $T_2$ which is connected as a diode, a resistor Y connected in series therewith, a multiple emitter transistor $T_3$ connected in series therewith, as well as a further resistor $R_3$ also connected in series. The bases of the transistor $t_1$ connected as a diode and the multiple emitter transistor $T_3$ are connected to each other.

In such a bandgap circuit, a temperature-independent reference voltage $U_{BG}$ which corresponds to the bandgap or energy gap of the semiconductor material of the components used in the circuit can be taken off at the diode-resistor path $T_2$, $R_3$. For silicon, this voltage is approximately equal to 1.2 volts.

Figure 2:
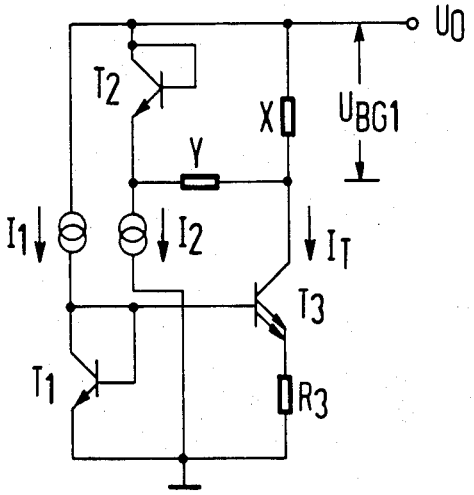
FIG. 2 is a circuit diagram of an embodiment according to the invention, wherein the same elements as found in the circuit configuration according to FIG. 1, are provided with the same reference symbols.

Contrary to the known circuit construction according to FIG. 1, in the embodiment according to FIG. 2 of the invention a series circuit of two resistors X and Y is connected in parallel with the transistor $T_2$ that is connected as a diode. In this diode-resistor path, a current is fed by way of a current source $I_2$. A temperature -independent reference voltage $U_{BG1}$ can be taken off at the resistor X.

Otherwise, the circuit configuration of the invention according to FIG. 2 does not differ from the known circuit configuration shown in FIG. 1.

If the current flowing in the output circuit (collector-emitter circuit) of the transistor $T_3$ is designated with reference symbol $I_T$, as is shown if FIGS. 1 and 2, the voltage $U_{BG}$ obtained according to FIG. 1 is:

$$U_{BG}=U_{BE}+Y\cdot I_T \tag{1}$$

wherein $U_{BE}$ refers to the base-emitter voltage of the transistor $T_2$ which is connected as a diode.

For the circuit according to FIG. 2, the following is correspondingly obtained for the voltage $U_{BG1}$:

$$\begin{aligned} U_{BG1} &= U_{BE}\frac{X}{X+Y} + I_T\frac{XY}{X+Y} \\ &= \frac{X}{X+Y}(U_{BE} + YI_T) \\ &= \frac{X}{X+Y}U_{BG} \end{aligned} \tag{2}$$

Thus, it is seen that the temperature-stable reference voltage $U_{BG1}$ in the circuit configuration according to FIG. 2 is proportional to the bandgap voltage $U_{BG}$ according to FIG. 1, wherein the proportionality factor is determined by the resistance of the series circuit of the two resistors X and Y. By the choice of the resistance values for the resistors X and Y, temperature-independent reference voltages can therefore be set, and be given a value which is different from the value of the bandgap voltage.

Figure 3:
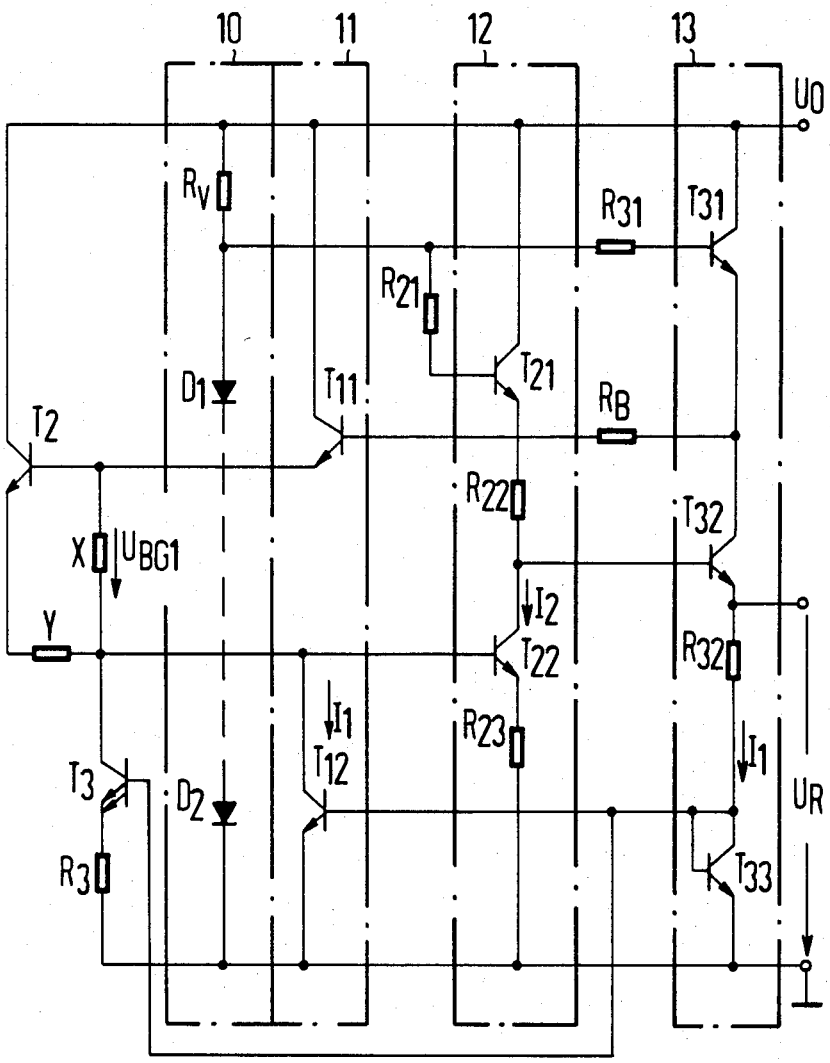
FIG. 3 is a circuit diagram of a circuit configuration for generating a d-c output voltage which is free of fluctuations of a d-c supply voltage, using a bandgap circuit according to FIG. 2.

An application of the circuit described above in connection with FIG. 2, in a circuit for generating a d-c output voltage $U_R$ which is free of fluctuations of a d-c supply voltage $U_O$, is shown in FIG. 3. It should be noted that such a circuit configuration for generating the voltage $U_R$ is described in co-pending U.S. patent application Ser. No. 416,060, filed Sept. 8, 1982 now U.S. Pat. No. 4,423,370 of Applicant, having the same filing date as the instant application and the title: "Circuit Configuration for Generating a D-C Output Voltage Independent of Fluctuations of a D-C Supply Voltage".

According to the circuit diagram of FIG. 3 of the drawing, a voltage stabilizing circuit 10 in the form of a series circuit of a series resistor $R_v$ as well as a diode chain $D_1$ $D_N$, is connected to a d-c supply voltave $U_o$ subject to fluctuations. At a tap between the resistor $R_v$ and the diode chain $D_1$ to $D_N$, a prestabilized voltage $U_v$ can be taken off.

Further connected to the d-c supply voltage $U_O$ is a reference voltage circuit 11 in the form of a voltage divider, which is formed by a constant-current source in the form of a transistor $T_{12}$ (optionally with an emitter resistor) and a potential shift branch in the form of a circuit of a transistor $T_{11}$ and the bandgap circuit according to FIG. 2.

An inverting amplifier 12 with a transistor $T_{22}$, a collector resistor $R_{22}$ and an emitter resistor $R_{23}$ which has a gain $-1$, is addressed by this reference voltage circuit 11. A further transistor $T_{21}$ is inserted into the collector circuit of the transistor $T_{22}$.

The inverting amplifier 12 controls an output driver 13 with a transistor $T_{32}$ connected as an emitter follower. A working or load resistor $R_{32}$ as well as a transistor $T_{33}$ which is connected as a diode, is connected in the emitter circuit of this transistor. The transistor $T_{33}$, together with the transistor $T_{12}$ in the reference voltage circuit 11, forms a current mirror, so that the same current designated with reference symbol $I_1$ flows through these two branches. A transistor $T_{31}$ is connected in the collector branch of the transistor $T_{32}$. The drive of the transistor $T_{31}$ will be described in greater detail below.

The output voltage $U_R$ can be taken off at the emitter of the transistor $T_{32}$ of the output driver 13.

In order to obtain a d-c output voltage $U_R$ which is independent over a wide range of the d-c supply voltage and the component parameters, the transistor $T_{21}$ in the inverting amplifier 12 is addressed by a resistor $R_{21}$, and the transistor $T_{31}$ in the output driver 13, is addressed through a resistor $R_{31}$ by the tap of the voltage stabilizing circuit, at which the prestabilized voltage $U_v$ is present. The coupling through the resistor $R_{21}$ in this case further improves the amplification in the direction toward a more accurate adjustment of the gain $-1$ of the inverting amplifier.

The transistor $T_{11}$ in the reference-voltage circuit is further addressed through a resistor $R_B$ from the junction point of the transistors $T_{31}$ and $T_{32}$ in the output driver 13. As described in the hereinafore-mentioned co-pending U.S. Application of applicant, the output voltage $U_R$ depends on the temperature independent reference voltage $U_{BG1}$ generated by the bandgap circuit.

In the circuit construction according to FIG. 3, the current source $I_1$ according to FIG. 2 is formed by the circuit of the transistors $T_{31}$, $T_{32}$ and the resistor $R_{32}$, and the current source $I_2$ according to FIG. 2 is formed by the transistor branch $T_{12}$. The diode $T_1$ according to FIG. 2 is formed by the diode $T_{33}$. Since a current mirror is formed by the elements $T_{12}$ and $T_{33}$, the currents $I_1$ and $I_2$ according to FIG. 2 are equal in the present case, i.e., in the circuit according to FIG. 3, the same current $I_1$ flows in both branches. In the circuit configuration according to FIG. 3, the transistor $T_2$ which forms a diode in the circuit according to FIG. 2, is connected somewhat differently. The collector of the transistor $T_2$ is connected to the supply voltage $U_O$, so that its base-emitter path forms the diode in the bandgap circuit.

The foregoing is a description corresponding to German Application No. P 31 37 504.9, dated Sept. 21, 1981, the International priority of which is being claimed for the instant application and which is hereby made part of this application. Any discrepancies between the foregoing specification and the aforementioned corresponding German application are to be resolved in favor of the latter.

I claim:

1. Voltage reference circuit arrangement based on energy gap voltage including a diode-resistance path at which a temperature-independent reference voltage corresponding to the energy gap of semiconductor material of components used in the circuit is available, the diode-resistance path comprising a diode and a series circuit of at least two resistors being connected in parallel with said diode, a temperature-independent reference voltage which is an independent fraction of the energy gap voltage of the semiconductor material being available at one of said resistors.

2. Bandgap circuit for generating a temperature-independent reference voltage, comprising:

a forward current-biased diode formed by a transistor base-emitter junction in parallel connection with a series combination of at least two resistors, a temperature independent voltage connected across the forward biased diode, a temperature-independent fractional reference voltage being provided across a first one of said series connected resistors, said fractional voltage independently selectable as the ratio of said first one of said at least two resistors and the sum of all of said resistors multiplied by said temperature independent voltage.

* * * * *